US005113812A

United States Patent [19]

Rembold et al.

[11] Patent Number: 5,113,812

[45] Date of Patent: May 19, 1992

[54] VALVE CONTROL APPARATUS WITH MAGNET VALVE FOR INTERNAL COMBUSTION ENGINES

[75] Inventors: Helmut Rembold, Stuttgart; Ernst Linder, Mühlacker, both of Fed. Rep. of Germany

[73] Assignee: Robert Bosch GmbH, Stuttgart, Fed. Rep. of Germany

[21] Appl. No.: 663,928

[22] PCT Filed: Jul. 28, 1990

[86] PCT No.: PCT/DE90/00585

§ 371 Date: Mar. 26, 1991

§ 102(e) Date: Mar. 26, 1991

[87] PCT Pub. No.: WO91/03627

PCT Pub. Date: Mar. 21, 1991

[30] Foreign Application Priority Data

Sep. 1, 1989 [DE] Fed. Rep. of Germany ..... 3929072

[51] Int. Cl.[5] ..... F01L 9/02; F01L 1/12; F02D 13/02

[52] U.S. Cl. ..... 123/90.12; 123/90.16

[58] Field of Search ..... 123/90.12, 90.13, 90.15, 123/90.16, 90.27

[56] References Cited

U.S. PATENT DOCUMENTS

| | | | |
|---|---|---|---|
| 4,466,390 | 8/1984 | Babitzka et al. | 123/90.12 |
| 4,674,451 | 6/1987 | Rembold et al. | 123/90.12 |
| 4,696,265 | 9/1987 | Nohira | 123/90.12 |
| 4,765,288 | 8/1988 | Linder et al. | 123/90.16 |
| 4,889,084 | 12/1989 | Rembold | 123/90.12 |
| 4,982,706 | 1/1991 | Rembold | 123/90.12 |

*Primary Examiner*—E. Rollins Cross
*Assistant Examiner*—Weilun Lo
*Attorney, Agent, or Firm*—Edwin E. Greigg; Ronald E. Greigg

[57] ABSTRACT

A hydraulic drive control device for internal combustion engines, having a reservoir magnet valve for controlling a volume of oil in a stroke transmission chamber, in order to control a timing cross section of the engine valve, wherein the magnet valve is closed when without current, and the valve member, embodied as a reservoir piston, is loaded by a reservoir spring acting as a closing spring.

26 Claims, 1 Drawing Sheet

VALVE CONTROL APPARATUS WITH MAGNET VALVE FOR INTERNAL COMBUSTION ENGINES

BACKGROUND OF THE INVENTION

The invention is based on a valve control apparatus with a magnet valve for internal combustion engines as defined hereinafter.

In an already-proposed valve control device for controlling the closing and opening time of an engine valve actuated by the valve control cam of a camshaft via an axially displaceable valve shaft (German Patent 38 15 668.7 now U.S. Pat. No. 4,889,084), the fluid reservoir is integrated with the magnet valve; the valve member serves as the reservoir piston, which divides a reservoir chamber from a magnet chamber, and the connection between the valve inlet and the reservoir chamber is controlled via one face edge of the reservoir piston in cooperation with the valve seat. The magnet acts counter to the direction of reservoir deflection, because in the specialized exemplary embodiment the magnet valve is intended to be open when without current, or in other words to be blocked only under voltage. This is intended to assure that the engine cannot race if the plug falls off the magnet valve. However, the consequence is that if the plug does fall off, the engine stays stopped. To attain the above proposed embodiment of the invention, in which on the one hand the fluid reservoir is integrated with the magnet valve and on the other hand the magnet valve is intended to be open when without current, entails not inconsiderable expenditure, in particular for construction, because the mechanical adjusting forces—that is, the reservoir force on the one hand and the opening force on the other—of the magnet valve counteract one another, so that at least two springs must engage the reservoir piston serving as the valve member. Not only must the necessary space for this be available, but the two springs must also be tuned very accurately to one another, which is especially difficult to achieve since this tuning must also take into account the forces exerted by the hydraulic pressures. Thus the static pressure, which engages the reservoir piston on the part of the reservoir spring, must necessarily be lower than the hydraulic pressure that is exerted by the engine valve and engages the reservoir piston. Only in this way is the desired reservoir effect possible. On the other hand, however, the static pressure must be greater than the oil supply pressure with which leakage and exclusion losses in the hydraulic oil from the valve control device are compensated for. Only in this way is it assured that upon reduction of the engine valve pressure, the reservoir piston will return to its outset position, from which it can be moved in the valve closing direction upon excitation of the magnet, or from which it can conversely deflect, upon reduced excitation and a buildup of tappet pressure.

To meet the requirements of both safety and comfort in a motor vehicle, the above safety shutoff means is inadequate in the event of loss of a plug from the magnet valve. If the plug drops off in this way, the situation in which the magnet valve sticks in the excited state cannot in fact be prevented, so engine racing is possible. Accordingly, it is indispensable to have additional devices that switch off the supply or ignition of fuel.

ADVANTAGES OF THE INVENTION

The valve control device according to the invention has an advantage over the prior art that the combined reservoir valve unit is substantially simpler in structure and as a spring for instance only has the reservoir spring. The allowable tolerance range in terms of forces and pressures is also expanded because when the magnet is not excited the reservoir piston no longer needs to assume an intermediate position but instead is held in its terminal position by the reservoir spring. Naturally it is true here as well that the static pressure that can be produced by the reservoir piston because of the reservoir spring must be higher than the leakage-compensating supply pressure, but in every case must be lower than the hydraulic pressure originating in the stroke transmission chamber of the engine inlet valve. The magnet itself can advantageously be embodied in the most various ways; the only definitive factor is that upon excitation of the magnet coil, the reservoir piston, as a movable valve member, is briefly lifted from its seat and then displaced onward as a reservoir by the fluid pressure of the engine valve. A simple trigger pulse is sufficient to effect this raising of the valve member. Another advantage is that valve opening is not effected as a function of a mechanical spring, whose force, because of the above-described force relationship, must be limited to a relatively low value, resulting in a certain inertia of this opening operation; instead, the drive is effected by the electromagnet, with the high response speed that this makes possible In an advantageous embodiment of the invention, the reservoir piston is embodied as a cup-shape and has a cup bottom oriented toward the reservoir chamber, the edge of which cup bottom cooperates with a valve seat existing between the valve inlet chamber and the reservoir chamber, and which cup bottom is radially guided on an inner wall of the control valve housing, and a central tang, structurally connected to the housing, plunges as a magnet yoke into the cup opening of the reservoir piston.

In a further advantageous embodiment of the invention, the magnet coil is disposed in the magnet chamber formed between the tang and the inner wall of the housing, as a result of which mounting of the reservoir/magnet valve unit can be simplified, but the structural volume can also be minimized.

In a further advantageous embodiment of the invention, a central bore for relieving the magnet chamber is present in the tang, which has considerable advantages in terms of attachment.

In a further advantageous embodiment of the invention, a throttle opening is present in the cup bottom dividing the magnet chamber and the reservoir chamber, in order to assure that the reservoir piston, after reduction of the engine valve pressure, again sealingly reaches the valve seat.

In a further advantageous embodiment of the invention, the reservoir chamber communicates with the crank case via a throttle bore and a check valve opening toward the reservoir chamber. Because of the throttle, changes in the engine oil pressure used as the system pressure now affect the pressure in the reservoir chamber only in an attenuated form.

In a further advantageous embodiment of the invention, the tang can serve as a stroke stop of the reservoir piston, and can also have a blind bore, into which the reservoir spring plunges partway. This blind bore may be at least deep enough that it receives the entire reservoir spring when the reservoir spring has been compressed into a block. This also saves additional space, which is beneficial in terms of the volume of the reservoir chamber.

In a further embodiment of the invention, the magnet coil is shut off electrically after the reservoir piston has been lifted from the valve seat. This saves considerable electrical energy, because only one pulse suffices for the actual actuation of the magnet valve, since further opening, if any control option does exist, is effected by means of the engine valve pressure. There is also the advantage that magnetic forces are not additionally superimposed on the control variables that engaging the reservoir piston, which are in the form of the engine valve pressure and the reservoir spring force.

Further advantages and advantageous features of the invention can be learned from the ensuing description, drawing and claims.

DRAWING

An exemplary embodiment is shown in the drawing and described in further detail below.

FIG. 1 is a longitudinal section through a valve control device, but in which a reservoir/magnet valve unit is not shown in section, and FIG. 2 is a longitudinal section on a larger scale through the reservoir/magnet valve unit.

DESCRIPTION OF THE EXEMPLARY EMBODIMENT

Figure 1:
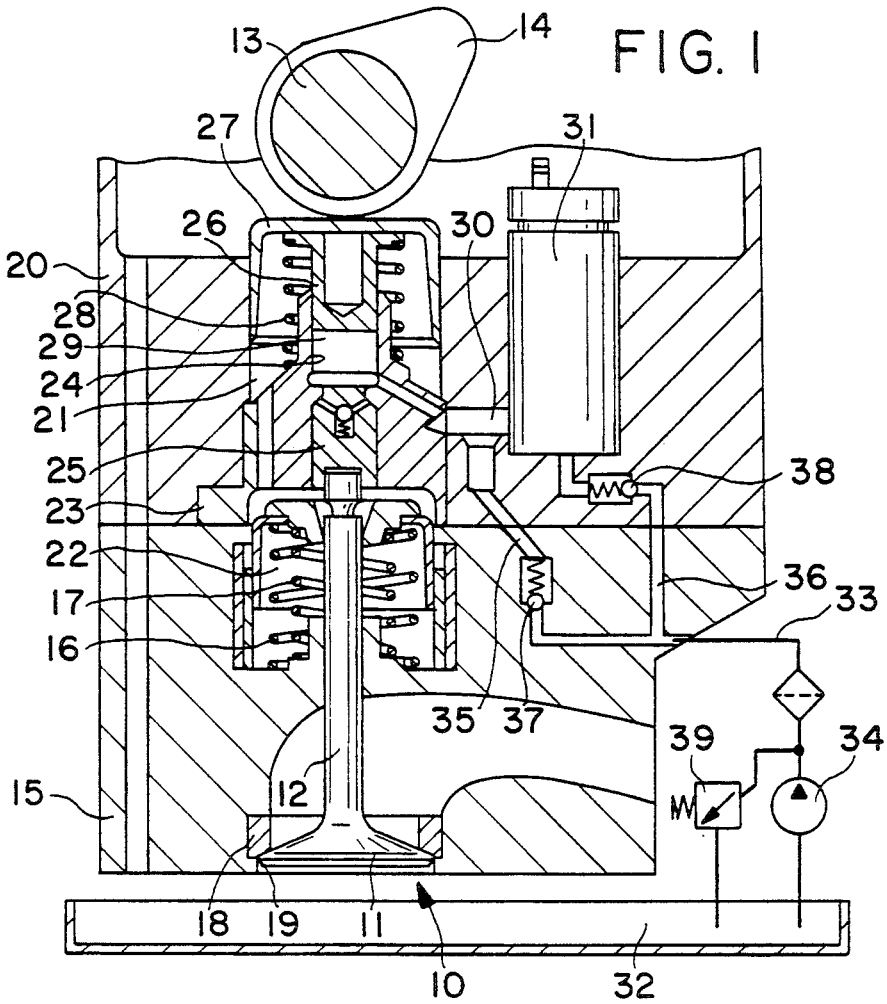

The valve control device shown in FIG. 1, for an inlet or outlet valve 10 of an internal combustion engine, is disposed between a valve shaft 12 that carries a valve member 11 and a valve control cam 14 that revolves with a camshaft 13. The valve shaft 12 is guided axially displaceably in a valve housing 15 and under the influence of two valve closing springs 16, 17 it rests with its valve member 11 on a valve seat 18 in the valve housing 15, the valve seat surrounding a valve inlet and outlet opening 19. The valve control device has a control housing 20 that is mounted on the valve housing 15 and in which a housing chamber 21 is disposed coaxially with a spring chamber 22 in the valve housing 15, the valve closing springs 16, 17 being accommodated coaxially to one another in this spring chamber 22. A housing block 23 is thrust into the housing chamber 21 from below and has a central, axially continuous housing bore 24. A valve piston 25 is joined to the valve shaft 12 and a piston part 26 is disposed above the valve piston and are axially displaceable in the housing bore 24. The cam piston 27 is pressed against the valve control cam, 14 by a restoring spring 28 supported in the housing block 23. The piston part 26 is pressed form-fittingly against the cam piston 27 via the restoring spring 28. The valve piston 25 and the piston part 26 define an oil-filled stroke transmission chamber 29, the effective axial length of which between the cam piston 27 and the valve piston 25 can be varied by relative motion of the pistons with respect to one another. The stroke transmission chamber 29 communicates, via a line 30, with a cylindrically embodied magnet control valve 31, which is not shown in section in FIG. 1, and the line 30 radially abuts the magnet control valve 31. Any oil leakage draining out of the valve control device is compensated for by a supply tank 32 by a feed pump 34 via a feed line 33; the line 33 branches into a line 35, which discharges into the line 30 connecting the stroke transmission chamber 29 and the magnet control valve 31, and a line 36, which leads to the magnet control valve 31, specifically to the lower face end thereof. One one-way check valve 37 and 38 that opens toward the magnet control valve 31 is disposed in the lines 35 and 36. The maximum feed pressure of the feed pump 34 is limited at the top by a pressure limiting valve 39, so that a certain oil supply pressure will not be exceeded.

Figure 2:
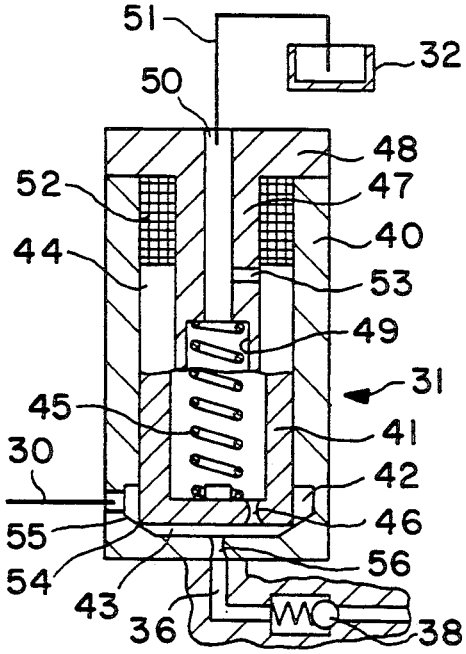

The quantity of oil present in the stroke transmission chamber 29 can be controlled by the magnet control valve 31 shown in section in FIG. 2. To this end, a cup-shaped reservoir piston 41 is disposed in the magnet valve housing 40 in an axially displaceable and radially sealing manner. In the closing position of the magnet valve, shown, this reservoir piston 41 divides an inlet chamber 42 from a reservoir chamber 43 and a magnet chamber 44. The reservoir piston 41 is loaded by a reservoir spring 45 that also acts as a closing spring, and on the piston bottom it has a throttle bore 46 through which the reservoir chamber 43 and the magnet chamber 44 communicates with one another. In a preferred embodiment, a throttle bore 56 is provided in the magnet valve housing 40 between the reservoir chamber 43 and the check valve 38. The reservoir spring 45 is supported on one of its ends remote from the reservoir piston 41 on a tang 47 of a housing cap 48, the tang being disposed coaxially with the reservoir piston 41; a blind bore 49 is provided to receive a portion of the reservoir spring 45 at the free end of the tang 47. A leakage conduit 50 is also provided in the tang 47, extending via a leakage line 51 to the oil tank 32. A magnet coil 52 is disposed in the annular chamber, formed by the magnet valve housing 40 and the tang 47, of the magnet chamber 44. This annular chamber, into which the reservoir piston 41 plunges with its annular wall upon displacement counter to the reservoir spring 45, also communicates via a leakage bore 53 with the leakage conduit 50, so that when it plunges into the chamber, a fluid backup between the magnet coil 52 and reservoir piston 41 inside the magnet chamber 44 is prevented from forming.

The valve control device described functions as follows:

For engine operation, the valve plate 11 is opened downward away from the valve seat by the valve control cam 14 at the proper time, and the inlet conduit to the combustion chamber is opened. To this end, via the cam piston 27 and counter to the force of the restoring spring 28, the piston part 26 is displaced into the oil-filled housing bore 24. Because oil is a virtually inelastic force transmitter, the valve piston 25 is positively displaced downward and in this process displaces the valve shaft 12, along with the valve plate 11, counter to the force of the valve closing springs 16 and 17. With an unchanged volume of fluid in the stroke transmission chamber 29, the opening stroke of the engine valve 10 corresponds to the height at which the valve control cam 14 is located, since the piston part 26 of the valve piston 25 have the same operating diameter. This working stroke of the valve shaft 12 is then varied by the magnet control valve 31 whenever the timing cross section between the valve plate 11 and the valve seat 18 is sufficiently large, for instance if the engine rpm is to be reduced by making this timing cross section smaller. In accordance with the timing cross section, the quantity of fuel and air mixture aspirated into the combustion chamber is reduced. To reduce this timing cross section, the magnet valve 31 is purposely opened beyond a certain working stroke, by exciting the coil 52 and, at least by the first current pulse, lifting the valve edge 54 of the reservoir piston 41 from the valve seat 55, so that the pressure prevailing in the stroke transmission chamber 29 is transmitted via the line 30 to the reservoir chamber 43, where by acting upon the lower face end of the reservoir piston 41 it displaces this piston upward counter to the force of the reservoir spring 45. The volume in the stroke transmission chamber 29 is reduced by this volume that is absorbed by the reservoir. By the action of the springs 16 and 17, the valve plate 11 closes ahead of time as a result. In this reservoir procedure in the combined reservoir and magnet valve 31, fluid present in the magnet chamber 44 is also carried to the oil tank, via the leakage bore 53 and/or leakage conduit 50 and the leakage line 51. As the valve control cam 14 continues to rotate, it reaches the base circle position, in which the piston part 26 is displaced all the way upward again by the restoring spring 28. In this movement, the reservoir piston 41 of the magnet control valve 31, driven by the reservoir spring 45, positively displaces the oil temporarily stored in it back via the line 30 to the stroke transmission chamber 29, until the reservoir piston 41 rests with its valve edge 54 on the valve seat 55. Any voids that come to form in the valve inlet chamber 42, the line 30 or the stroke transmission chamber 29 are filled with oil via the feed pump 34 and the feed line 33; a return flow through the check valve 37 is prevented, so that upon being driven again by the valve control cam 14, the outset situation is again attained. Via the line 36 and the check valve 38, oil flows continuously from the feed pump 34 into the reservoir chamber 43 and from there, via the throttle bore 46, into the magnet chamber 44 and back into the oil tank 32, so that constant filling of the reservoir chamber 43 at a constant low pressure is assured here. The throttle 56 preferably provided between the check valve 38 and the reservoir chamber 43 is smaller in diameter than the throttle 46 and has the effect that changes in the engine oil pressure used as a system pressure will affect the pressure in the reservoir chamber only in attenuated form.

The foregoing relates to preferred exemplary embodiments of the invention, it being understood that other variants and embodiments thereof are possible within the spirit and scope of the invention, the latter being defined by the appended claims.

we claim:

1. A valve control device for controlling a closing and opening time of an engine valve of an internal combustion engine, the valve being actuated by a valve control cam of a camshaft via an axially displaceable valve shaft, comprising a stroke transmission chamber disposed between the valve control cam and the valve shaft, a fluid flow conduit connected with said stroke transmission chamber by which said stroke transmission chamber is filled with fluid for varying its effective axial length between the valve control cam and the valve shaft, a magnet control valve, said fluid flow conduit is controllable by said magnet control valve, for draining and delivering the fluid, to said stroke transmission chamber, said conduit discharges on one end into a fluid reservoir in said magnet control valve, said fluid reservoir is integrated with a reservoir piston in said magnet control valve, said reservoir piston acts in an opening direction beyond a position that uncovers a flow opening from said fluid flow conduit, said reservoir piston of said magnet control valve (31) is closed when without current, and said reservoir piston (41) is loaded by a reservoir spring (45) acting as a closing spring.

2. A valve control device as defined by claim 1, in which said reservoir piston (41) is embodied as cup-shaped and has a cup bottom oriented toward the reservoir chamber (43), an edge (54) of said cup bottom cooperates with a valve seat (55) which exist between a valve inlet chamber (42) and the reservoir chamber (43), and said cup bottom is radially guided on an inner wall of the magnet control valve housing (40), and that a central tang (47), structurally connected to the housing, plunges as a magnet yoke into a cup opening of the reservoir piston (41).

3. A valve control device as defined by claim 2, in which a magnet coil (52) is disposed in an annular chamber of a magnet chamber (44) formed between the tang (47) and an inner wall of the housing (40).

4. A valve control device as defined by claim 2, in which a central bore (50) for relieving the magnet chamber (44) is present in the tang (47).

5. A valve control device as defined by claim 3, in which a central bore (50) for relieving the magnet chamber (44) is present in the tang (47).

6. A valve control device as defined by claim 2, in which a throttle opening (46) is present in the cup which divides the magnet chamber (44) from the reservoir chamber (43).

7. A valve control device as defined by claim 3, in which a throttle opening (46) is present in the cup which divides the magnet chamber (44) from the reservoir chamber (43).

8. A valve control device as defined by claim 4, in which a throttle opening (46) is present in the cup which divides the magnet chamber (44) from the reservoir chamber (43).

9. A valve control device as defined by claim 5, in which a throttle opening (46) is present in the cup which divides the magnet chamber (44) from the reservoir chamber (43).

10. A valve control device as defined by claim 2, in which the reservoir chamber (43) communicates with a crank case of said internal combustion engine via a throttle bore (56) and a check valve (38) opening toward the reservoir chamber (43).

11. A valve control device as defined by claim 3, in which the reservoir chamber (43) communicates with a crank case of said internal combustion engine via a throttle bore (56) and a check valve (38) opening toward the reservoir chamber (43).

12. A valve control device as defined by claim 4, in which the reservoir chamber (43) communicates with a crank case of said internal combustion engine via a throttle bore (56) and a check valve (38) opening toward the reservoir chamber (43).

13. A valve control device as defined by claim 5, in which the reservoir chamber (43) communicates with a crank case of said internal combustion engine via a throttle bore (56) and a check valve (38) opening toward the reservoir chamber (43).

14. A valve control device as defined by claim 6, in which the reservoir chamber (43) communicates with a crank case of said internal combustion engine via a throttle bore (56) and a check valve (38) opening toward the reservoir chamber (43).

15. A valve control device as defined by claim 2, in which the central tang (47) serves as a stroke stop of the reservoir piston (41), and that a reservoir spring (47) plunges partway into a blind bore (49) of the tang (47).

16. A valve control device as defined by claim 3, in which the central tang (47) serves as a stroke stop of the reservoir piston (41), and that a reservoir spring (47) plunges partway into a blind bore (49) of the tang (47).

17. A valve control device as defined by claim 4, in which the central tang (47) serves as a stroke stop of the reservoir piston (41), and that a reservoir spring (47) plunges partway into a blind bore (49) of the tang (47).

18. A valve control device as defined by claim 5, in which the central tang (47) serves as a stroke stop of the reservoir piston (41), and that a reservoir spring (47) plunges partway into a blind bore (49) of the tang (47).

19. A valve control device as defined by claim 6, in which the central tang (47) serves as a stroke stop of the reservoir piston (41), and that a reservoir spring (47) plunges partway into a blind bore (49) of the tang (47).

20. A valve control device as defined by claim 10, in which the central tang (47) serves as a stroke stop of the reservoir piston (41), and that a reservoir spring (47) plunges partway into a blind bore (49) of the tang (47).

21. A valve control device as defined by claim 3, in which a supply of current to the magnet coil (52) can be interrupted after the reservoir piston (41) has been lifted from the seat (54).

22. A valve control device as defined by claim 4, in which a supply of current to the magnet coil (52) can be interrupted after the reservoir piston (41) has been lifted from the seat (54).

23. A valve control device as defined by claim 5, in which a supply of current to the magnet coil (52) can be interrupted after the reservoir piston (41) has been lifted from the seat (54).

24. A valve control device as defined by claim 6, in which a supply of current to the magnet coil (52) can be interrupted after the reservoir piston (41) has been lifted from the seat (54).

25. A valve control device as defined by claim 10, in which a supply of current to the magnet coil (52) can be interrupted after the reservoir piston (41) has been lifted from the seat (54).

26. A valve control device as defined by claim 15, in which a supply of current to the magnet coil (52) can be interrupted after the reservoir piston (41) has been lifted from the seat (54).

* * * * *